US006833886B2

(12) United States Patent
Suzuki et al.

(10) Patent No.: US 6,833,886 B2
(45) Date of Patent: Dec. 21, 2004

(54) LIQUID CRYSTAL DISPLAY CONTROL CIRCUIT THAT PERFORMS DRIVE COMPENSATION FOR HIGH-SPEED RESPONSE

(75) Inventors: Toshiaki Suzuki, Kawasaki (JP); Koshu Yonemura, Kawasaki (JP); Katsuyoshi Hiraki, Kawasaki (JP); Hiroshi Yamazaki, Kawasaki (JP); Katsunori Tanaka, Kawasaki (JP)

(73) Assignee: Fujitsu Display Technologies Corporation, Kawasaki (JP)

( * ) Notice: Subject to any disclaimer, the term of this patent is extended or adjusted under 35 U.S.C. 154(b) by 431 days.

(21) Appl. No.: 10/094,438

(22) Filed: Mar. 8, 2002

(65) Prior Publication Data

US 2002/0140652 A1 Oct. 3, 2002

(30) Foreign Application Priority Data

Mar. 29, 2001 (JP) ..... 2001-096101

(51) Int. Cl.[7] ..... G09G 3/36
(52) U.S. Cl. ..... 349/87
(58) Field of Search ..... 345/87, 94, 95, 345/98, 99, 100, 101, 55, 211, 212, 213, 214, 545

(56) References Cited

U.S. PATENT DOCUMENTS 5,496,265 A * 3/1996 Langley et al. ..... 604/6.01

FOREIGN PATENT DOCUMENTS

| | | |
|---|---|---|
| JP | 6-83569 | 3/1994 |
| JP | 6-195043 | 7/1994 |
| JP | 8-304772 | 11/1996 |
| JP | 9-81083 | 3/1997 |
| WO | WO 99/05567 | * 2/1999 |

* cited by examiner

*Primary Examiner*—Dennis-Doon Chow
(74) *Attorney, Agent, or Firm*—Greer, Burns & Crain, Ltd.

(57) ABSTRACT

Since the drive data for display or their correction values are stored in correspondence with the combination of the upper bits of the current frame image data and the upper bits of the previous frame image data, the capacity of the high-speed memory circuit that stores the conversion table can be reduced. Accompanying the reduction in the capacity of the conversion table, since the precision of the display drive data or their correction values becomes lower, an interpolation circuit is provided and, by means of an interpolation calculation the display, drive data or their correction values having increased precision is generated and consequently the input image data is corrected to generate the display drive data.

15 Claims, 13 Drawing Sheets

FIG. 4

CORRECTION VALUE CONVERSION TABLE (nFo <= nFi + Δo)

| | nFi | | | | | | | | | |
|---|---|---|---|---|---|---|---|---|---|---|
| (n−1)Fp | 0/63 | 8/63 | 16/63 | 24/63 | 32/63 | 40/63 | 48/63 | 56/63 | 63/63 | |
| 0/63 | – | 11 | 22 | 23 | 20 | 16 | 11 | 6 | 0 | |
| 8/63 | 0 | – | 12 | 16 | 14 | 11 | 8 | 5 | 0 | |
| 16/63 | 0 | −7 | – | 6 | 8 | 7 | 6 | 4 | 0 | |
| 24/63 | 0 | −8 | −8 | – | 4 | 5 | 5 | 3 | 0 | |
| 32/63 | 0 | −8 | −13 | −5 | – | 3 | 3 | 2 | 0 | |
| 40/63 | 0 | −8 | −15 | −9 | −4 | – | 2 | 2 | 0 | |
| 48/63 | 0 | −8 | −15 | −13 | −8 | −3 | – | 1 | 0 | |
| 56/63 | 0 | −8 | −15 | −18 | −11 | −6 | −2 | – | 0 | |
| 63/63 | 0 | −8 | −16 | −21 | −15 | −10 | −5 | −1 | – | |
| | | | | | | | | | | |

FIG. 5

DIFFERENTIAL VALUE CONVERSION TABLE (nFp <= nFi + Δp)

| | nFi (IMAGE DATA OF CURRENT FRAME) | | | | | | | | | |
|---|---|---|---|---|---|---|---|---|---|---|
| (n−1)Fp | 0/63 | 8/63 | 16/63 | 24/63 | 32/63 | 40/63 | 48/63 | 56/63 | 63/63 | |
| 0/63 | – | 0 | −4 | −3 | −1 | −1 | 0 | 0 | −7 | |
| 8/63 | 0 | – | −1 | 0 | 0 | 0 | 0 | 0 | −3 | |
| 16/63 | 0 | 0 | – | 0 | 0 | 0 | 0 | 0 | −2 | |
| 24/63 | 2 | 0 | 0 | – | 0 | 0 | 0 | 0 | −1 | |
| 32/63 | 4 | 0 | 0 | 0 | – | 0 | 0 | 0 | −1 | |
| 40/63 | 8 | 0 | 0 | 0 | 0 | – | 0 | 0 | −1 | |
| 48/63 | 11 | 4 | 0 | 0 | 0 | 0 | – | 0 | 0 | |
| 56/63 | 14 | 6 | 0 | 0 | 0 | 0 | 0 | – | 0 | |
| 63/63 | 16 | 8 | 0 | 0 | 0 | 0 | 0 | 0 | – | |
| | | | | | | | | | | |

CORRECTION VALUE CONVERSION TABLE

| | | |
|---|---|---|
| a | a | a |
| a | a | a |
| b | b | b |
| b | b | b |

| | | |
|---|---|---|
| a | b | a |
| b | a | b |
| a | b | a |
| b | a | b |

LIQUID CRYSTAL DISPLAY CONTROL CIRCUIT THAT PERFORMS DRIVE COMPENSATION FOR HIGH-SPEED RESPONSE

BACKGROUND OF THE INVENTION

1. Field of the Invention

The present invention relates generally to a control circuit of a liquid crystal display device, and more particularly to a liquid crystal display control circuit which makes high-speed response possible by adding a correction value to the cell drive voltage to effect drive compensation and which, furthermore, has a simplified circuit configuration for drive compensation.

2. Description of the Related Arts

Liquid crystal display devices have spread widely as energy-saving and space saving display devices. From use in prior arts as display devices displaying the still images of computers, there have, in recent years, been proposals for use as display devices used for televisions to display moving images.

The liquid crystal display panel has a source electrode to which a display drive voltage according to display data is applied, a gate electrode driven at scan timing and, provided at their cross position, a cell transistor and pixel electrodes. Via the cell transistor, the display drive voltage is applied to the liquid crystal layer between the pixel electrodes to change the transmittance of the liquid crystal layer whereby the desired image display is carried out.

In the case of using a liquid crystal display panel as a display device for television, it is necessary, for example, to display 60 image frames in 1 second and on account of this it is necessary to complete the change in transmittance of the liquid crystal layer within the period of one frame, which is approximately 16 msec. Applying the display drive voltage on the source electrode and applying the same voltage between the pixel electrodes within the period of 1 frame can be performed comparatively easily, but it may be difficult, depending on the displayed image, to completely change the optical characteristics (for example the transmittance) of the liquid crystal layer within the period of 1 frame. For example, a comparatively long time is necessary in order to change from the condition of a black display of zero transmittance to the condition of an intermediate color display of 25% transmittance.

Although depending on the response characteristics of the liquid crystal material, in the case where liquid crystal materials having poor response characteristics are used, there are difficulties in changing from the condition of zero transmittance to the condition of 25% transmittance within the period of 1 frame. Furthermore, depending on the liquid crystal material, there are cases where the response time to change from the condition of zero transmittance to a certain degree of transmittance is longer than the response time to change from the condition of 25% transmittance to a greater transmittance. Or, there is the same problem in the case of changing the transmittance in the opposite of the direction.

A compensation drive method is being proposed as a method to compensate for the slowness of the response characteristics of these kinds of liquid crystal materials. In this method, considering the post drive state of the previous frame and the drive level of the current frame are considered, the most suitable drive level for the liquid crystal layer to be able to complete a change in transmittance within the period of one frame is calculated, and the voltage of that drive level is applied to the pixel electrodes. For example, in the case of changing a condition of zero transmittance at the previous frame period to 50% transmittance at the present frame, the pixel electrodes are driven not by a drive level voltage corresponding to a transmittance of 50%, but by a higher drive level voltage than that. As a result, even though the response characteristics of the liquid crystal layer is slow, the response of the liquid crystal layer to the higher drive voltage becomes faster and it is possible to change to the targeted transmittance state within 1 frame period. This is also the same in the case of changing from a state of high transmittance to a state of low transmittance.

It is necessary to provide a display drive data generation circuit in the control circuit of a liquid crystal display device that converts input image data into drive data for display for the purpose of performing the drive compensation. The display drive data generation circuit forms, by means of calculation, the compensated display drive data of the input image data of the current frame and the post-drive status data of the previous frame. The calculation involved is complicated and if it is executed by a special logic circuit the calculation circuit becomes more complicated and yields an increase in cost of the liquid crystal display device.

Therefore the provision of a conversion table in the display drive data generation circuit, which can directly find the display drive data, can be considered. However, the concerned conversion table needs a comparatively high cost circuit such as an SRAM which is capable of being accessed with high-speed and the conversion table itself also becomes the cause of an increase in cost of the liquid crystal display device.

SUMMARY OF THE INVENTION

It is therefore the object of the present invention is to provide a control circuit of a liquid crystal display device that performs drive compensation at a reduced cost.

Another object of the present invention is to provide a liquid crystal display control circuit that can have a more simple display drive data generation circuit for drive compensation.

In order to achieve the objects, a first aspect of the present invention has, in a control circuit of a liquid crystal display device, a display drive data generation unit which generates display drive data from an image data of a current frame and an image data of a previous frame, and said display drive data generation unit has a conversion table that stores the display drive data or their correction values, corresponding to combinations of the image data of the current frame and the image data of the previous frame. Furthermore, the conversion table stores display drive data or their correction values corresponding to combinations of the upper bits of the current frame image data and the upper bits of the previous frame image data so that the size of this conversion table is made smaller. Furthermore, the display drive data generation unit has an interpolation calculation unit that calculates, in accordance with the lower bits of the current frame image data, the display drive data or their correction values, corresponding to the lower bits, by means of an interpolation calculation, from a plurality of contiguous display drive data or their correction values read out from the conversion table. Thus, in the case where the interpolation calculation unit calculates the correction values, it has a drive level calculation unit that corrects the current frame image data in accordance with the calculated correction value to generate the display drive data. The display drive data is provided to a source driver and a drive voltage, corresponding to the display drive data, is applied to the pixel electrodes through the source electrode and cell transistor.

According to the above control circuit, since the drive data for display or their correction values are stored in correspondence with the combination of the upper bits of the current frame image data and the upper bits of the previous frame image data, the capacity of the high-speed memory circuit that stores the conversion table can be reduced. Accompanying the reduction in the capacity of the conversion table, since the precision of the display drive data or their correction values becomes lower, an interpolation circuit is provided and, by means of an interpolation calculation the display, drive data or their correction values having increased precision is generated and consequently the input image data is corrected to generate the display drive data.

BRIEF DESCRIPTION OF THE DRAWINGS

The above and other objects, aspects, features and advantages of the present invention will become more apparent from the following detailed description when taken in conjunction with the accompanying drawings, in which:

FIG. 4 shows an example of a correction value conversion table;

FIG. 5 shows an example of a differential value conversion table;

FIG. 14 is for the purpose of explaining pseudo-contour and the dispersion processing;

DESCRIPTION OF THE PREFERRED EMBODIMENTS

An embodiment of the present invention will be described hereafter with reference to the drawings. However, the protective scope of the present invention is not limited to the embodiment which follows, but extends to the invention defined in claims and its equivalents.

Figure 1:
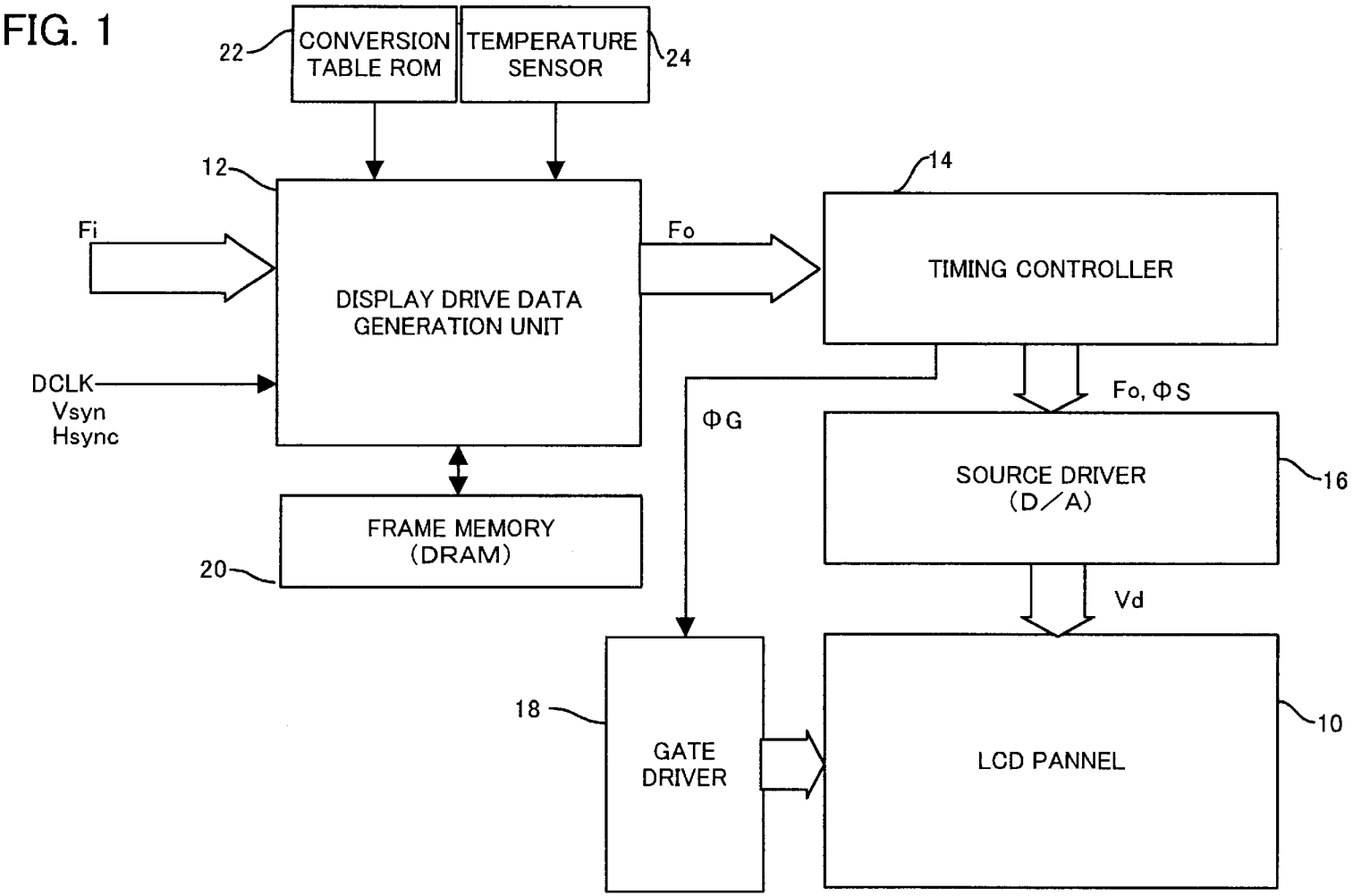
FIG. 1 is an overall complete configuration diagram of the liquid crystal display device of the present embodiment.

FIG. 1 is an overall configuration diagram of the liquid crystal display device of the present embodiment. The liquid crystal display device in the diagram has, in connection with a liquid crystal display panel 10 such as TFT, a source driver 16 that drives source electrodes by means of display drive voltages Vd and a gate driver 18 that drives gate electrodes connected to the gate of cell transistors. Input image data Fi having gradation value corresponding to the pixels is supplied from a host computer in synchronized to a dot clock DCLK, and a display drive data generation unit 12 generates display drive data Fo having a gradation value necessary for display driving from the input image data Fi. This display drive data Fo is generated in considering the following drive compensation method. Display drive data Fo is supplied to a timing controller 14, serial/parallel converted and display drive data Fo for one-line is provided to the source driver 16 at a predetermined timing. So far, there are the processing circuit for a digital data.

Furthermore, the source driver 16 has a digital/analog conversion circuit. The digital signal of display drive data Fo is converted to an analog signal so as to generate the display drive signal Vd is formed corresponding to the liquid crystal characteristics.

Furthermore, the liquid crystal display device has a conversion table ROM 22 that stores conversion table data to be downloaded to a conversion table internally provided in the display drive data generation unit 12, a temperature sensor 24 and a frame memory 20 that stores image data of the previous frame and the like.

Figure 2A:
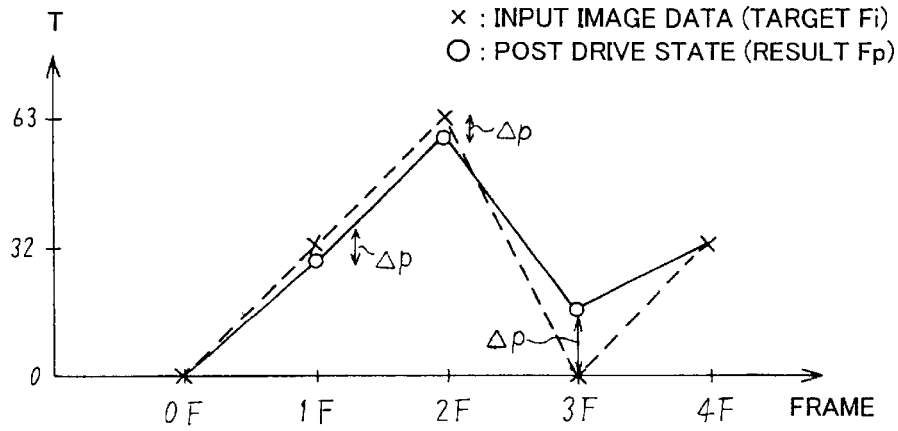
FIG. 2 is for the purpose of explaining the theory of drive compensation.
Figure 2B:
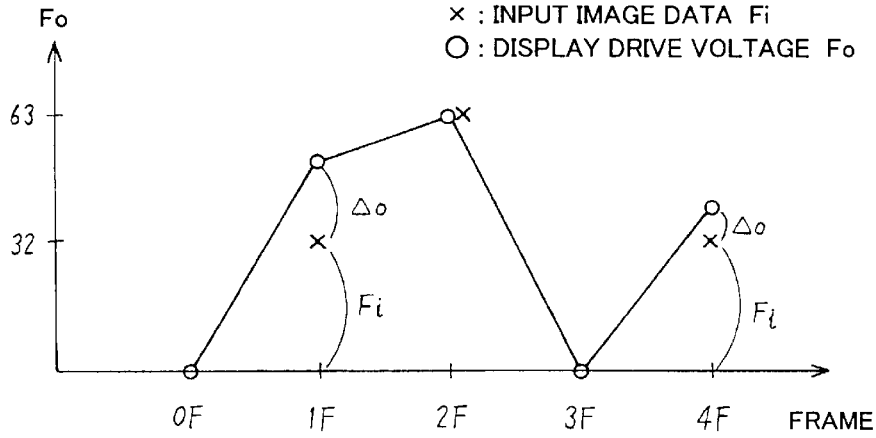

FIG. 2 is for the purpose of explaining the theory of drive compensation. FIG. 2A shows the time period of a frame on the horizontal axis and the transmittance T (64 Gradations) which are the optical characteristics of the liquid crystal layer of the pixels on the vertical axis, and the x in the diagram shows input image data Fi and the ○ shows the post-drive states of the liquid crystal layer. Furthermore, FIG. 2B shows the time period of a frame on the horizontal axis and the vertical axis shows the display drive voltage Fo (64 Gradations).

In the example in FIG. 2, the input image data Fi has a gradation value equal to 0 at frame 0F, the next, a gradation value equal to 32 at frame 1F, the next, a gradation value equal to 0 at frame 3F and then, the next, a gradation value equal to 32 at frame 4F. In this case, input image data Fi is equal to 32 at frame 1F but, considering the slow response characteristics of the liquid crystal layer, display drive data Fo is set with a gradation value which is added a correction value Δo to input image data Fi. It is possible to attain a targeted transmittance equal to 32 as close as possible from a condition of transmittance equals 0 in the previous frame within the period of frame 1F by adding this correction value Δo. This is drive compensation.

At frame 2F, the target value of the input image data is the maximum gradation level Fi=63. Consequently, display drive data Fo is set at the maximum gradation of the drive voltage level (63). As shown in FIG. 2A, at frame 1F the transmittance T of the liquid crystal layer does not reach to the target value of the gradation value of the input image data but attains a transmittance T of a differential Δp lower.

Next, at frame 3F the target value of the input image data is the minimum gradation level Fi=0. In this case a correction value cannot be added to the display drive data Fo and is set at the minimum gradation of the drive voltage level equal to 0. As a result of that, the transmittance of the liquid crystal layer does not reach to the minimum gradation within the period of frame 3F but becomes a level higher than the minimum gradation level by the differential Δp.

Next, the target value of the input image data is of Fi being equal to 32 at frame 4F. The display drive level Fo is, in such cases, set higher than the level of the input image data Fi by the correction value of Δo. However, being different from the case in frame 1F where there is a change from the liquid crystal state of the previous frame (transmittance equal to 0) to a transmittance equal to 32, at frame 4F there is smaller change from a transmittance equal to 16 to a transmittance equal to 32. Consequently, the correction value of Δo at frame 4F is set to be smaller than the correction value of Δo at frame 1F.

According to the drive compensation method, the display drive data Fo corresponding to the liquid crystal drive voltage is, as in the manner, set according to the relationship between the input image data Fi of the previous frame and the input image data Fi of the current frame. If the differences of both image data is larger, a correction value Δo corresponding to that is added to input image data Fi of the current frame.

Furthermore, in the case where the response characteristics of the liquid crystal layer are slow, there are situations where even though a correction value is added to the drive level in the above manner, the target value of the level of the input display data Fi is not attained. In that case, the post drive liquid crystal state (transmittance T) data Fp of the previous frame is used as a substitute for the input image data Fi of the frame. That is, the display drive data Fo of the current frame is set in accordance with the post-drive status (transmittance T) data Fp of the previous frame and the input image data Fi of the current frame and a drive voltage is generated in accordance with that FO.

In order to execute the above method, it is necessary to temporarily store the post-drive status data Fp in the memory in order to calculate the display drive data Fo of the next frame. And it is necessary to find, for each frame, the display drive data Fo together with the post-drive status data Fp of that frame. This calculation is carried out at the display drive data generation unit 12 of FIG. 1. The display drive data generation unit 12 has a correction value conversion table and a differential value conversion table as reference data, in order to carry out high-speed calculation, and downloads this table data in the conversion table ROM 22 to two conversion tables provided internally. In that case, the most suitable table data is selected if necessary in accordance with a frequency such as a vertical synchronous signal or the detected temperature from the temperature sensor 24, and downloaded.

Figure 3:
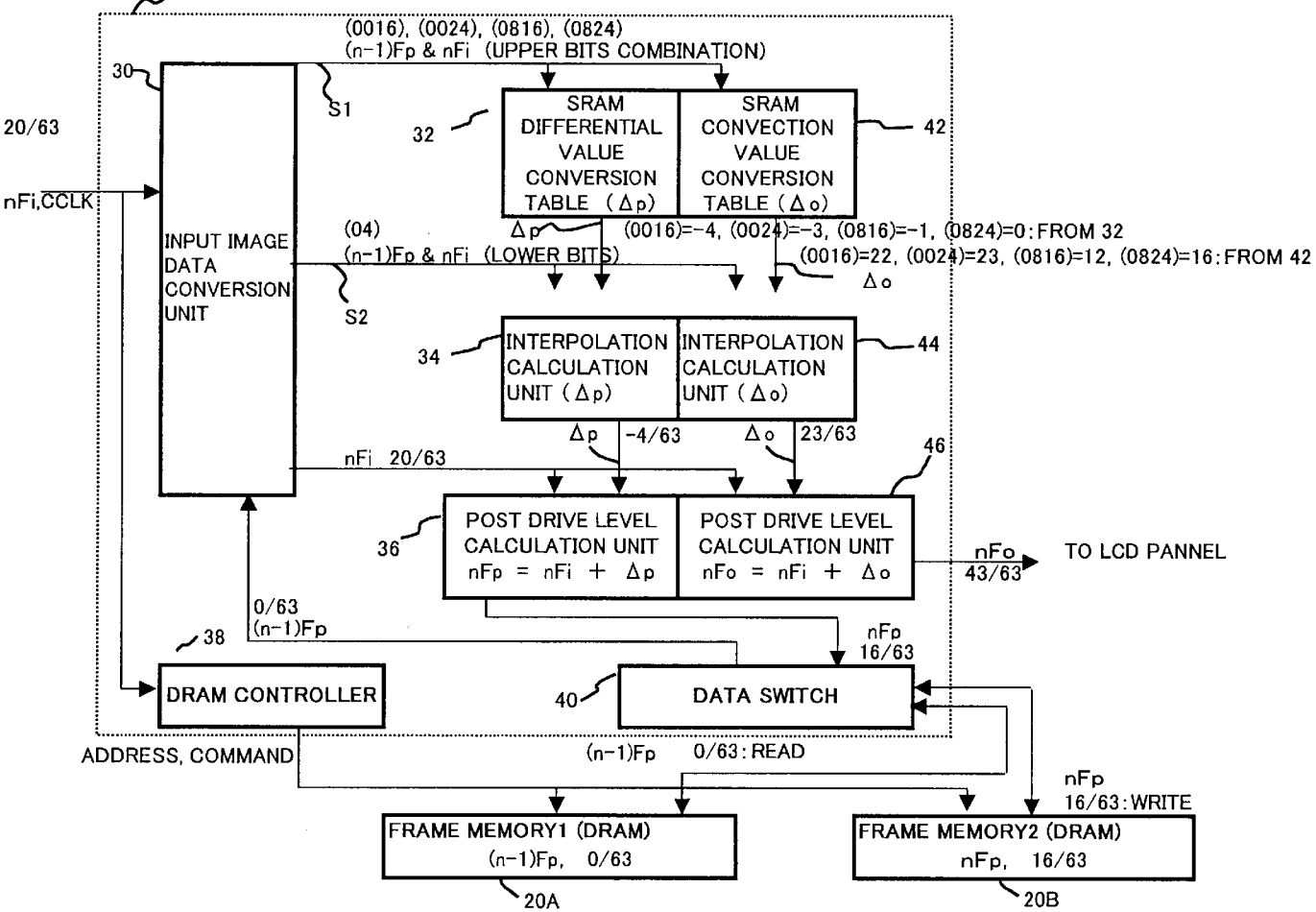
FIG. 3 shows the configuration of display drive data generation unit 12 in the embodiment.

FIG. 3 shows the configuration of the display drive data generation unit 12 in the present embodiment. In the figure, the input image data of the current frame (numbered n) is nFi, the display drive data of the current frame is nFo, the post-drive status data of the current frame is nFp and furthermore, the respective data of the previous frame (numbered n−1) is (n−1)Fi, (n−1)Fo and (n−1)Fp. The display drive data generation unit 12 has, for the purpose of drive compensation, a drive level correction value conversion table 42 and a post drive level differential value conversion table 32. These tables 42 and 32 have a correction value and a differential value corresponding to the combination of input image data of the current frame nFi and post-drive status data of the previous frame (n−1)Fp.

FIG. 4 shows an example of a correction value conversion table. According to that illustrated, a drive level correction value Δo, corresponding to the combination of post-drive status data of the previous frame (n−1)Fp and input image data of the current frame nFi, is stored in the correction value conversion table. In this example the post-drive status data of the previous frame (n−1)Fp and input image data of the current frame nFi are together the data of 64 gradations (6 bits).

For example, if the input image data of the current frame nFi is 8/63 (level 8 of 63 gradations) in relation to the post-drive status data of the previous frame (n−1)Fp being 0/63 (level 0 of 63 gradations), the correction value Δo equals 11. Consequently, the level of the input image data nFi with the correction value Δo added to it becomes display drive data nFo equal to 19/63. In the same manner, if the input image data of the current frame nFi is 32/63, the correction value Δo becomes equal to 20 and the display drive data nFo equals nFi+Δ which equals 32+20 equal to 52/63.

To the contrary, in the case where the post-drive status data of the previous frame (n−1)Fp is 63/63, i. e. the maximum level, the opposite correction value Δo becomes a negative value and the display drive data nFo becomes a level lower than the input image data nFi by the correction value Δo. Furthermore, in the case where the post-drive status data of the previous frame (n−1)Fp is 32/63, if the input image data of the current frame nFi is lower than 32/63 the correction value Δo becomes negative and if higher, becomes positive.

Furthermore, when the input image data of the current frame nFi is the lowest level and highest level of 0/63 and 63/63, the respective correction values cannot be added and image drive data nFo stays at the level of input image data nFi.

FIG. 5 shows an example of a differential value conversion table. This table stores differential value Δp of the drive level corresponding to the combination of post-drive status data of the previous frame (n−1)Fp and input image data of the current frame nFi. In this example, the post-drive status data of the previous frame (n−1)Fp and input image data of the current frame nFi are together the data of 64 gradations (6 bits).

As shown by this, in the case where the image data of the current frame nFi is 0/63, higher the level of the post-drive status data of the previous frame (n−1)Fp is, larger the differential value Δp becomes, and the level of the post-drive status of the current frame becomes a level that does not reach the object value. That is, such condition is the condition from frame 2F to 3F of FIG. 2A. To the contrary, in the case where the image data of the current frame nFi is 63/63, lower, the level of the post-drive status data of the previous frame (n−1)Fp is larger the differential value Δp becomes and the level of the post-drive status of the current frame becomes a level that does not reach the object value.

Figure 6:
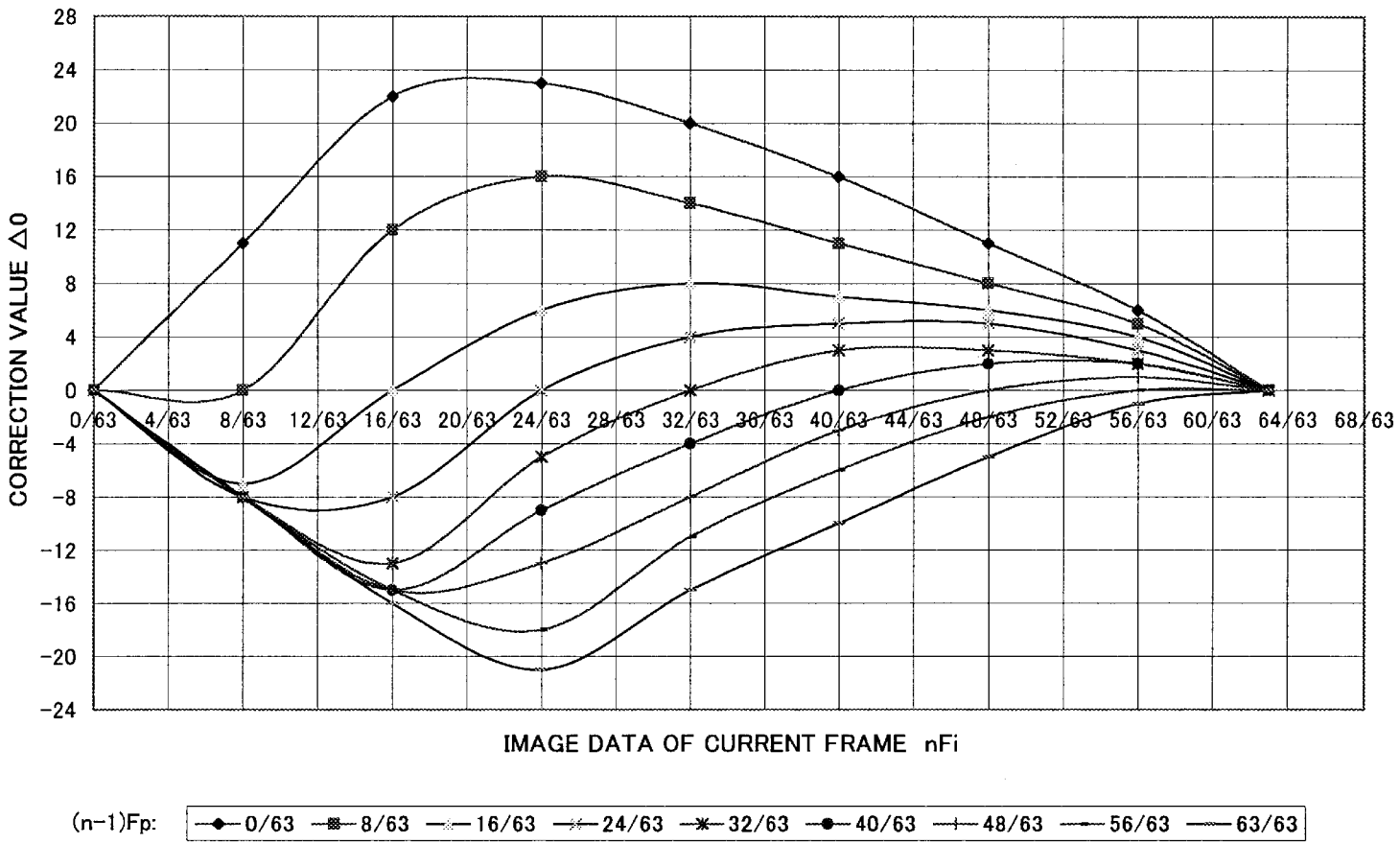
FIG. 6 shows a graph of the correction value conversion table.

FIG. 6 shows a graph of the correction value conversion table. The correction value Δo of the correction value conversion table of FIG. 4 is on the vertical axis, the image data of the current frame nFi is on the horizontal axis and correction values have been plotted corresponding to 9 types of post-drive status data of the previous frame (n−1)Fp. The setting of the correction values can be easily understood by means of this graph.

Figure 7:
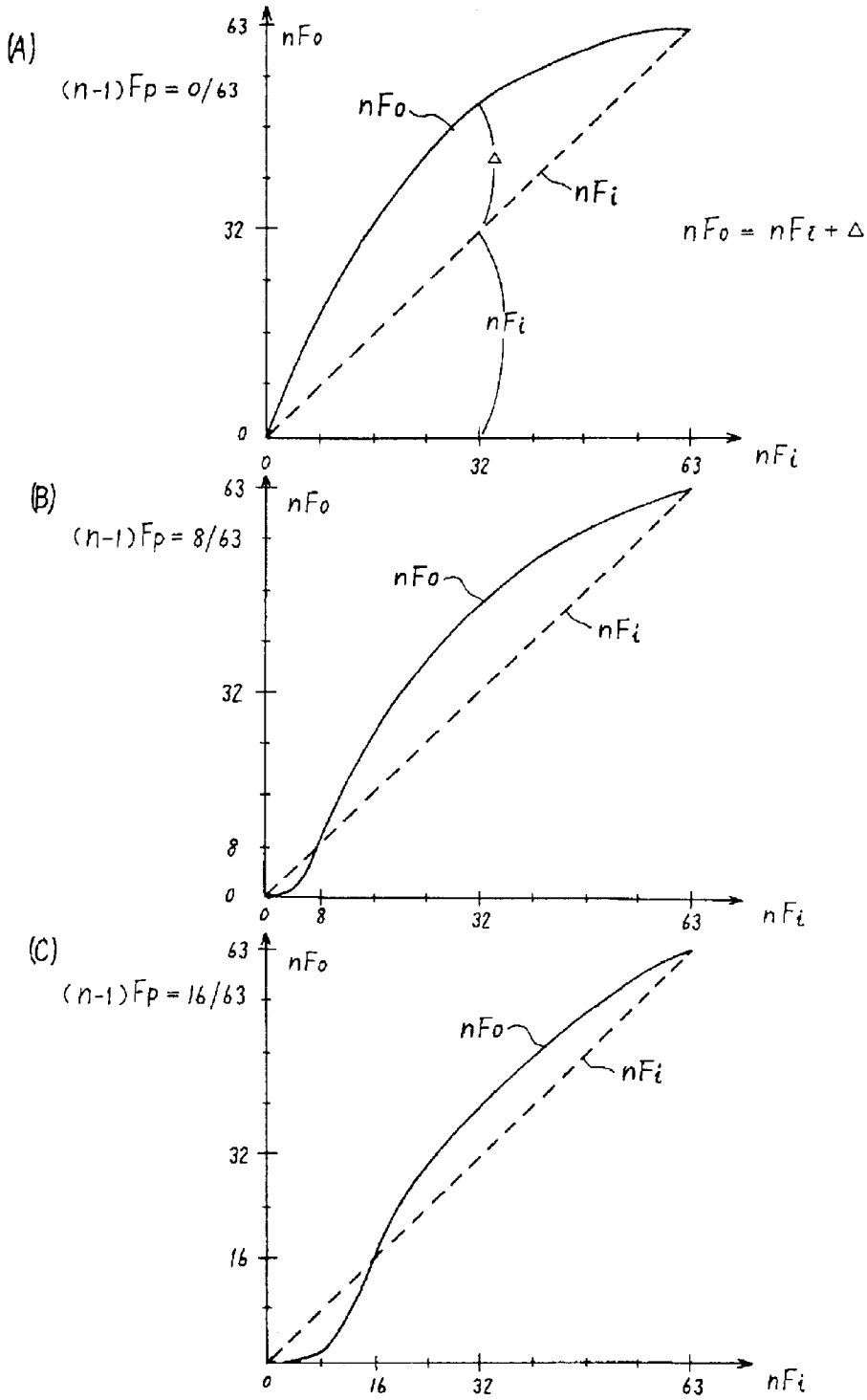
FIG. 7 shows display drive data nFo found by adding the correction value of FIG. 6 to image data nFi of the current frame.
Figure 8:
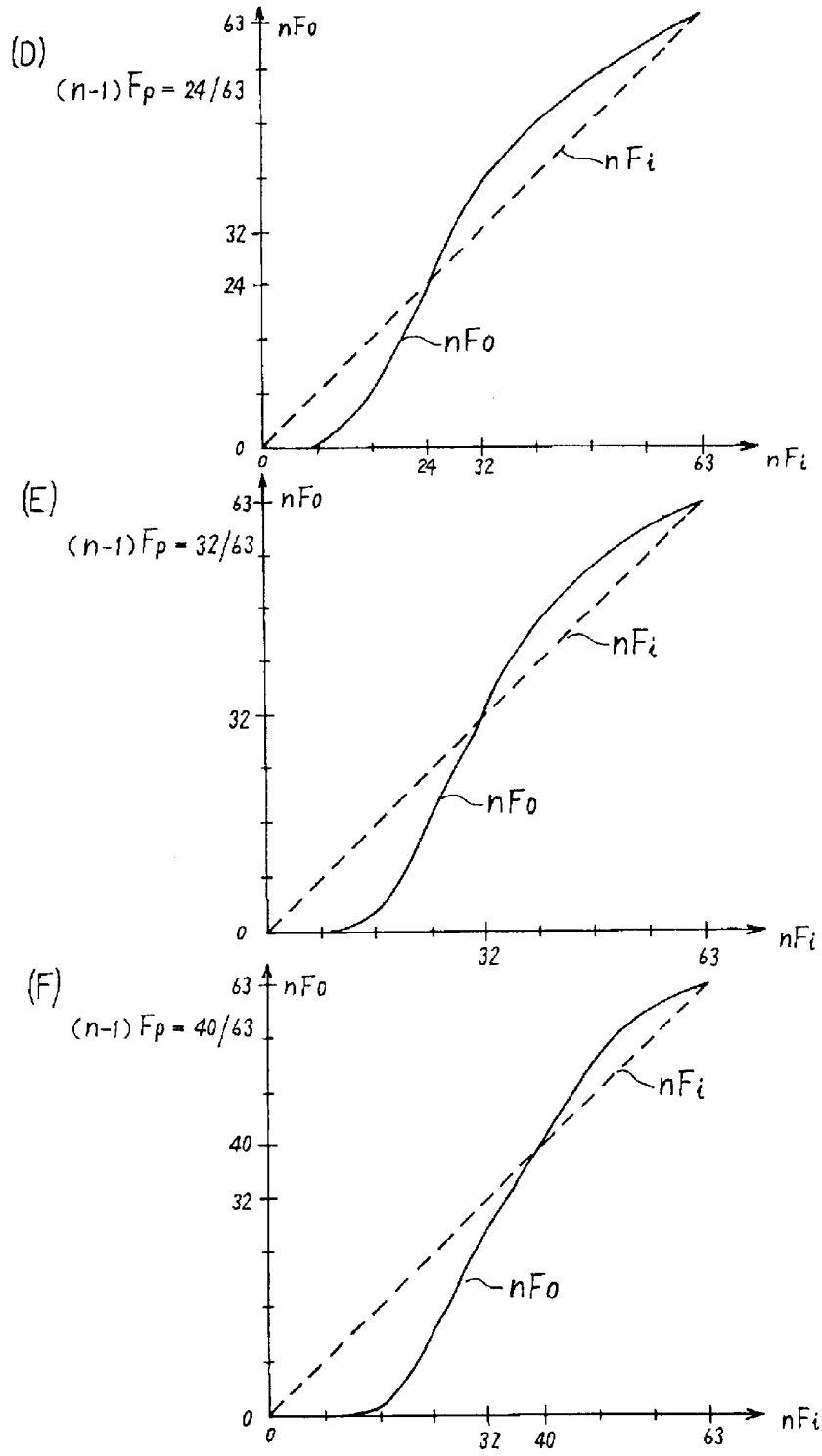
FIG. 8 shows display drive data nFo found by adding the correction value of FIG. 6 to image data nFi of the current frame.
Figure 9:
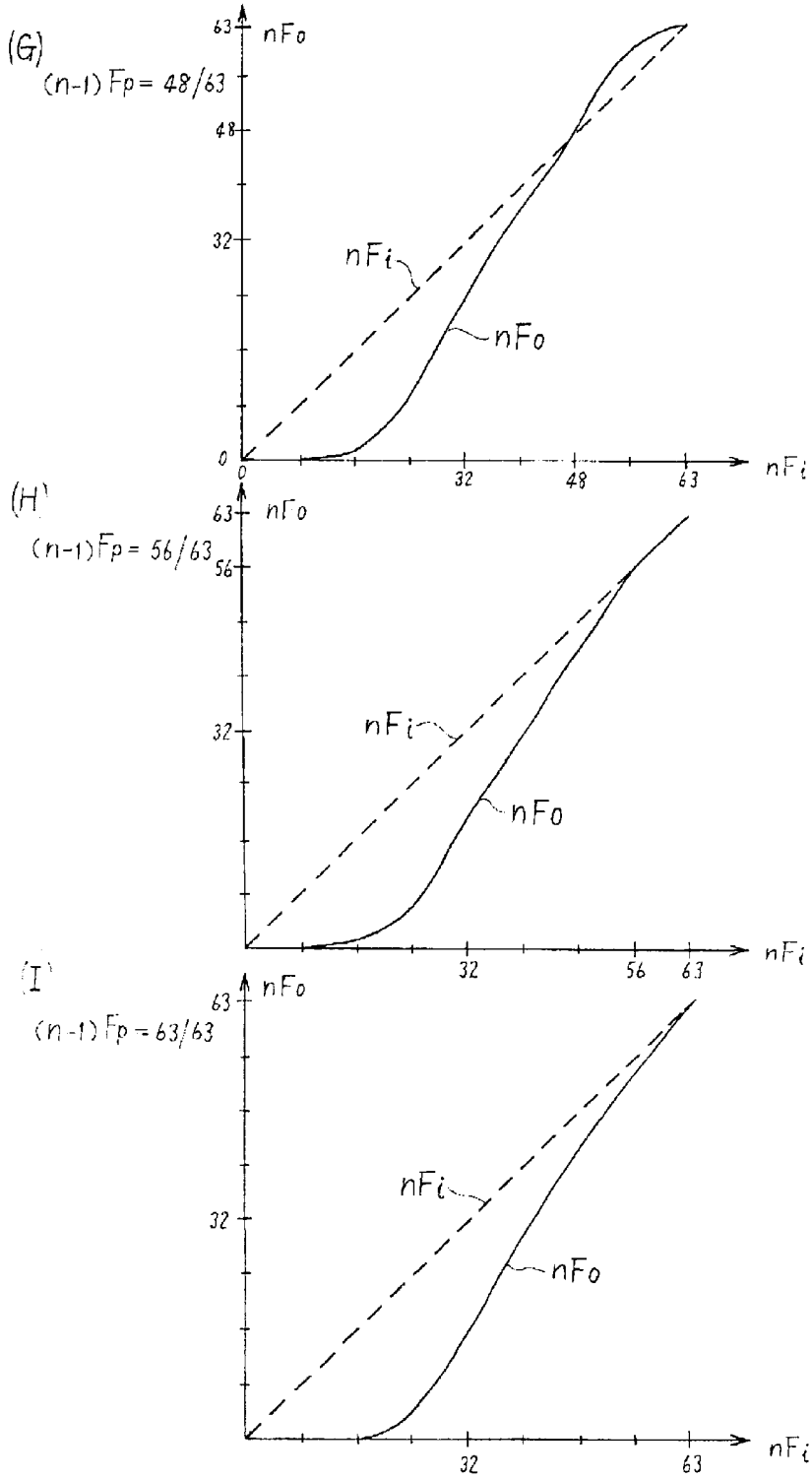
FIG. 9 shows display drive data nFo found by adding the correction value of FIG. 6 to image data nFi of the current frame.

FIGS. 7 to 9 shows display drive data nFo which can be found by adding the correction values of FIG. 6 to the image data of the current frame nFi. Put simply, the broken line of FIGS. 7 to 9 shows the image data of the current frame nFi and the solid line respectively shows the display drive data nFo. As is shown by (A) in FIG. 7, in order to show the image data of the current frame nFi from a 0/63 level of the previous frame, drive level nFo, as shown by the solid line, is formed by the display drive data generation unit 12. In this case the correction value Δo is always positive. To the contrary, as is shown in (I) of FIG. 9, in order to show the image data of the current frame nFi from a 63/63 level of the previous frame, drive level nFo is formed as shown by the solid line.

Returning to FIG. 3, the configuration of the display drive data generation unit 12 will be further described. Display drive data generation unit 12 has an input image data conversion unit 30 that receives input image data nFi and dot clock CCLK and generates signal S1 which combines post-drive status data of the previous frame and image data of the current frame in order to refer to the conversion tables 32 and 42. Furthermore, the display drive data generation unit 12 has the correction value conversion table 42, the differential value conversion table 32, and interpolation calculation units 34 and 44 that find a highly precise correction value Δo and differential value Δp by means of an interpolation calculation to the correction value Δo and differential value Δp read out from these conversion tables and, furthermore, calculation units 36 and 46 that add the correction value Δo and differential value Δp to the current frame image data nFi. Thus, a DRAM controller 38 supplies read and write command and address to 2 frame memories 20A and 20B and a data switching unit 40 performs switching of the frame memories 20A and 20B.

Frame memories 20A and 20B store the post-drive status data of the previous frame (n−1)Fp and, on the other side store the post-drive status data of the current frame is nFp. Thus, when the display drive data is generated, by means of memory controller 38, the post-drive status data of the previous frame (n−1) Fp is read out from one side of the frame memories and supplied to the input image data conversion unit 30 and the post-drive status data of the current frame nFp, generated by means of the calculation unit 36, is written to the other side of the frame memory.

By means of the present embodiment, the combined data S1 used for reference, is a combination of the respective upper bits of the post-drive status data of the previous frame (n−1)Fp and the input image data of the current frame nFi in order to reduce the capacity of the SRAM that stores the correction value conversion table 42 and the differential value conversion table 32. For example, if the respective data (n−1)Fp and nFi becomes 6 bits (64 gradations), the combination of the upper 3 bits is the reference data in this example. In that case, according to that shown in FIG. 4, the correction value conversion table 42 comes to store 8×8=64 correction values Δo. In the same manner, according to that shown in FIG. 5, the differential value conversion table 32 also comes to store 8×8=64 differential values Δp. Comparing to the instance of a combination (=64×64=4096) of the post-drive status data of the previous frame (n−1)Fp and the input image data of the current frame nFi, the capacity of the SRAM used by the conversion tables 32 and 42 can be made smaller by $1/64^{th}$.

As above, together with the shrinking of the capacity of the conversion tables 42 and 32, the correction value Δo and differential value Δp read out from the respective conversion tables have a very much reduced precision. Therefore, the display drive data generation unit 12 has the correction value interpolation calculation unit 44 and the differential value correction calculation unit 34 that carry out interpolation calculations in accordance with a combination of the lower bits of the post-drive status data of the previous frame (n−1)Fp and the input image data of the current frame nFi. These interpolation calculation units 44 and 34 are supplied with S2, being a combination of the respective lower 3 bits of the post-drive status data of the previous frame ((n−1)Fp and the input image data of the current frame nFi from the input image data conversion unit 30 so that the correction value and differential value relating to the data between the grid points of the conversion tables 32 and 42 are generated by means of linear interpolation.

Thus it has a drive level calculation unit 46 and the post drive data calculation unit 36 that adds the correction value Δo and differential value Δp generated by the interpolation calculation units 44 and 34 to the current frame image data nFi. A drive level calculation unit 46 generates the display drive data nFo of the current frame by means of the calculation method shown in the diagram and outputs it to the liquid crystal panel side. Furthermore, the post drive level calculation unit 36 generates the post drive data nFp of the current frame by means of the calculation method shown in the diagram and, via the data switching unit 40, writes this into one side of the frame memory 20B. The post drive data nFp, that has been written in, is read out at the next (n+1) frame as post drive data of the previous frame, supplied to the input image data conversion unit 30 and is used in generating the display drive data and post drive data at the next (n+1) frame in order.

Only the upper bits only of the post drive data nFp may be written into one side of the frame memory 20B. In that case, these upper bits of the post drive data can be included in upper bit combination signal S1 that goes to the conversion tables 32 and 42 but cannot be included in lower bit combination signal S2 that goes to the interpolation calculation units 34 and 44. Consequently, in that case, the interpolation calculation units 34 and 44 carry out interpolation calculations in accordance with only the lower bits of image data nFi of the current frame.

Now, an explanation will be carried out of the operation of display drive data generation unit 12 concerning a case from where the post-drive status at the previous frame (n−1)F has a transmittance T equal to 0/63 to where the input image data nFi at the next frame 1F is 20/63.

6 bits of the post drive data (n−1)Fp equal to 0/63 of the previous frame is stored at a first frame memory 20A as an initial state. Thus, 6 bits of the input image data nFi equal to 20/63 is input. DRAM controller 38 reads out the post drive data (n−1)Fp equal to 0/63 of the previous frame from the first frame memory 20A and this data is supplied to input image data conversion unit 30 via data switching unit 40. Input image data conversion unit 30 generates, from image data nFi of the current frame and post drive data (n−1)Fp of the previous frame, upper bit combination data S1 which is for the purpose of referring to the conversion tables 32 and 42. In this case, as is shown by the conversion table of FIG. 4, concerning an nFi equal to 20/63 and an (n−1)Fp equal to 0/63, since there are no correction values or differential values at the grid points on the conversion tables corresponding to the combination of them, it is necessary to read out a plurality of contiguous grid points, for example the data of 4 grid points, to those grid points. Therefore, concerning an nFi equal to 20/63 and an (n−1)Fp equal to 0/63, input image data conversion unit 30 generates, as illustrated, (n−1)Fp&nFi=(00,16), (00,24), (08,16), (08,24), as upper bit combination data S1. This upper bit combination data is shown by 64 gradation data for the purpose of explanation but in actuality is the combined respective data of 3 bits (8 gradations).

The following correction values Δo and differential values Δp, corresponding to this upper bit combination data S1, are read out from the correction value conversion table 42 and the differential value conversion table 32.

$$\Delta:(00,16)=22,\ (00,24)=23,\ (08,16)=12,\ (08,24)=16$$

$$\Delta:(00,16)=-4,\ (00,24)=-3,\ (08,16)=-1,\ (08,24)=0$$

Next, the interpolation calculation units 44 and 34 find, by means of an interpolation calculation, highly precise correction values and differential values from these 4 points of the correction values and differential values corresponding to an nFi equal to 20/63 and an (n−1) Fp equal to 0/63. For this purpose, input image data conversion unit 30 generates the lower bit combined data S2 of an nFi equal to 20/63 and an (n−1)Fp equal to 0/63 and supplies this to the interpolation calculation units 44 and 34. That is to say, the lower bit combined data S2 becomes $$(n-1)Fp\&nFi=(0,4)$$

as shown. As a result of that, the correction value interpolation calculation unit 44 respectively calculates that:

$$\Delta=[[\{22\times(8-4)+23\times4\}/8]\times(8-0)+[\{12\times(8-4)+16\times4\}/8]\times0]\div8=22.5\approx23$$

$$\Delta=[[\{(-4)\times(8-4)+(-3)\times4\}/8]\times(8-0)+[\{(-1)\times(8-4)+0\times4\}/8]\times0]\div8=-3.5\approx-4$$

This interpolation calculation is performed by means of a linear interpolation calculation.

Next, drive level calculation unit 46 adds correction value Δo equal to 23/63 and image data nFo equal to 20/63 of the current frame and yields display drive data nFo equal to 43/63. In the same manner the post drive level calculation unit 36 adds differential value Δp equal to −4/63 and image data nFi equal to 20/63 of the current frame and yields post-drive status data ((n−1)Fp equal to 16/63. Display drive data nFo is supplied to the timing controller 14 of FIG. 1 and converted to a drive voltage by means of the source driver 16. Furthermore, post-drive status data (n−1)Fp is written into the second frame memory 20B.

As above, by reducing the bits of the reference data, the capacity of the conversion table 42 used for converting the input image data into display drive data in order to employ the drive compensation method, is made smaller and, in correspondence with that, the interpolation calculation unit 44 is provided and decline in precision is prevented.

Furthermore, the data stored in conversion table 42 is not display drive data but is a correction value Δo concerning the input image data. As is shown in FIG. 4, if this is the correction value, since the necessary number of gradations of Δ0 become fewer, the number of bits of the data stored in the conversion table can also be made fewer. By this means the capacity of the SRAM of the conversion table can, furthermore, be made smaller. Of course, the data within conversion table 42 can also be display drive data (data where a correction value has been added to input image data). In this case, the drive level calculation unit 46 becomes unnecessary. Whether the data within conversion table 42 is a correction value or display drive data is determined by comparing the effect of decreasing the capacity of the SRAM of the conversion table with the effect of providing the drive level calculation unit.

As has been described above, in the case where the response characteristics of the liquid crystal layer are slow, there is a situation where the object transmittance is not attained within a frame period even though drive compensation is performed. In that case, there is a necessity to consider the state of transmittance after the liquid crystal layer has been driven. For this purpose, in the present embodiment the differential value conversion table 32 is provided and its interpolation calculation unit 34 is provided. This differential value conversion table 32 is also made fewer capacity by decreasing the number of bits of the reference data. Furthermore, in the case where the data within the differential value conversion table 32 is not the differential value but the post-drive status data nFp, the post drive data calculation unit 36 becomes unnecessary.

Even the conversion table 32, the post-drive status data and not the differential value can be stored. In that case the post drive data calculation unit 36 becomes unnecessary.

In the preferred embodiment the display drive data generation unit 12 is constructed by means of ASIC. By decreasing the capacity of SRAM's that form the conversion tables 42 and 32, the number of gates of peripheral circuits necessary for the SRAM's can be greatly decreased and the number of gates for use with the SRAM's can be economized on.

Figure 10:
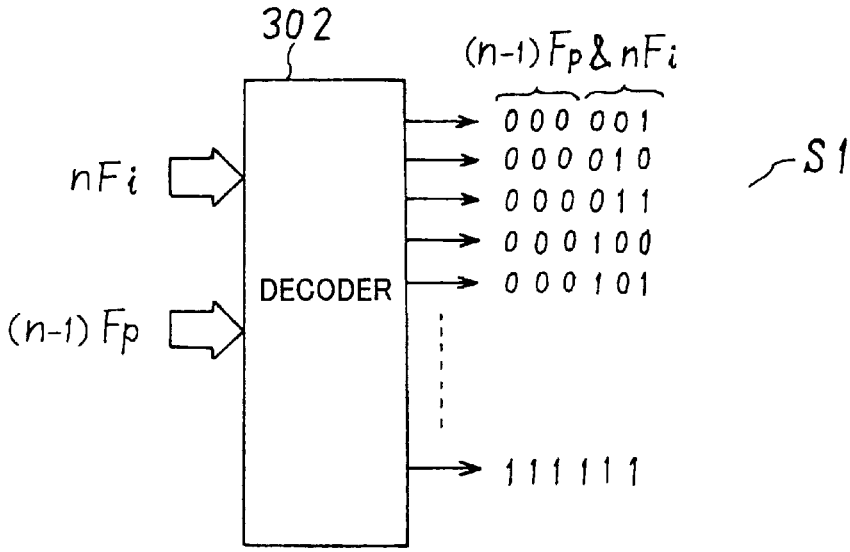
FIG. 10 shows an exemplary configuration of input image data conversion unit 30.

FIG. 10 shows an exemplary configuration of the input image data conversion unit 30. A decoder 302 is provided in the input image data conversion unit 30 and by means of this decoder 302, combined data S1 ((n−1)Fp&nFi) is generated, from input image data nFi and the post-drive status (n−1)Fp of the previous frame, as the address of the conversion table 42 for reference.

Figure 11:
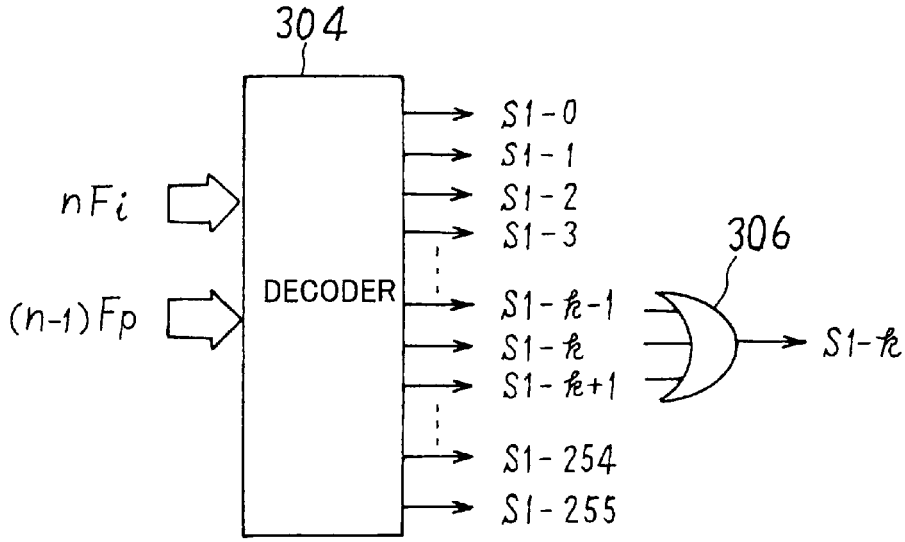
FIG. 11 shows another exemplary configuration of input image data conversion unit 30.

FIG. 11 shows another exemplary configuration of the input image data conversion unit 30. In this example, a decoder 304 generates an output of 8 bits (256 gradations) from 6 bits of input image data nFi and 6 bits of post-drive status data (n−1)Fp. Furthermore, it has an OR gate 306 that groups together a plurality of outputs of a region where there is little fluctuation of the correction value Δo and differential value Δp within the 256 outputs S1-0 to S1-255. Put simply, in regions where changes to the data of the conversion table are large, data is stored with higher resolution and, in regions where the change is small, the data is thinned out and stored with lower resolution. By this means the capacity of the conversion table can be made smaller and, together with this, the precision of the generated correction value and differential value can be raised.

[Second Embodiment]

CR drive has been proposed as a drive method of a liquid crystal display device for the purpose of improving the quality of moving image. In CR (Charge and Reset), a drive voltage is applied to the pixel electrodes in the first half of the frame period, in the second half of the frame period the drive voltage is made to be zero, so that a certain portion of the frame period is a black display. It has been reported that, by this means, the movements of the animation can be seen to be smooth. Generally the duty ratio is set to be 50% or less and accordingly, a liquid crystal layer that can perform high-speed response is a prerequisite in order to carry out CR drive. In the case where the frame period is 16 ms a response speed of less than 8 ms becomes necessary and there is a limit to the applied liquid crystal layer material.

In the second embodiment, in order to apply this CR drive to even a liquid crystal layer material of a medium speed where the response speed is limited to 20 ms, the drive compensation method is used for the CR drive. That is to say, the display drive data of the current frame is generated from the post drive data of the previous frame and the image data of the current frame and is supplied to the panel driver, further the post drive data of the current frame is generated from the post drive data of the previous frame and image data of the current frame and is stored in the frame memory. In each respective calculation, an increased speed can be attempted by referring to the conversion tables. More preferably, reducing the bits of the data used for referring to the conversion tables the capacity of the conversion tables is reduced.

Figure 12:
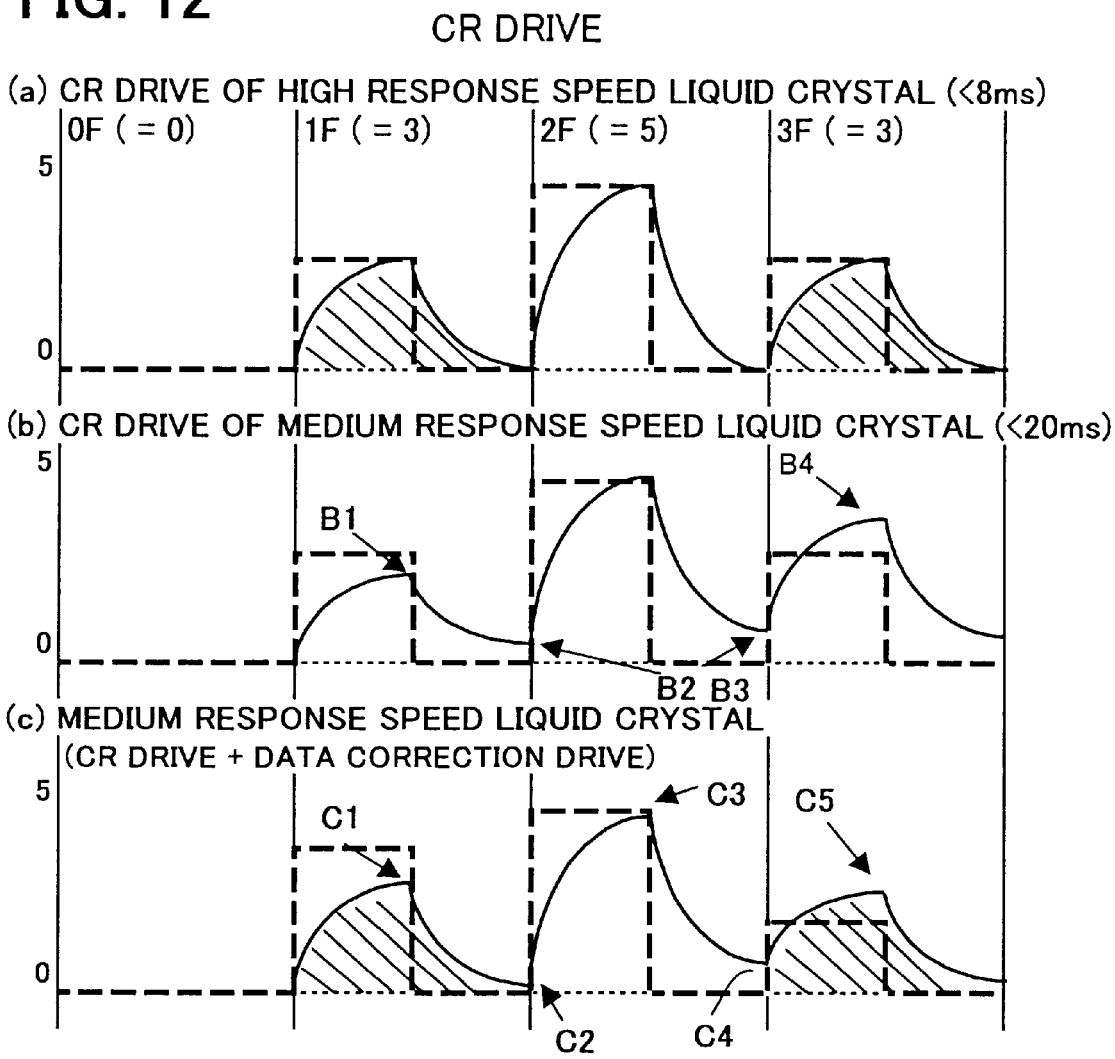
FIG. 12 is for the purpose of explaining the CR drive in the embodiment.

FIG. 12 is a drawing for the purpose of explaining the CR drive in this embodiment. (a) of FIG. 12 shows the CR drive waveform (broken line) and changes in the transmittance of the liquid crystal in the case where a high response liquid crystal layer was used. In this example display image data having 5 gradations were used for the purpose of simplicity. At the first frame 0F the display image data is 0 and, at the next frames 1F, 2F, 3F the display image data changes to 3, 5, 3. A drive pulse corresponding to display image data [3] is applied in the first half of frame 1F and resets to drive voltage zero in the second half. Together with this, the transmittance of the liquid crystal layer attains the targeted transmittance in the first half and in the second half returns to transmittance zero (black color). Frame 2F and 3F are the same. Having high-speed response characteristics the targeted transmittance can be attained in the first half of a frame period and can return to transmittance in the remaining half.

(b) of FIG. 12 shows the CR drive waveform and changes in the transmittance of the liquid crystal in the case where a medium response speed liquid crystal layer was used. In this example the input image data changed to 0,3,5,3 at frames 0F, 1F, 2F and 3F. The drive pulse in the first half of the frame period cannot make the liquid crystal layer respond satisfactorily and an insufficient response B1 occurs and, even the reset pulse in the second half of the frame period cannot make the liquid crystal layer respond satisfactorily and an insufficient response B2 occurs. Thus, at frame 2F, a large response remnant B2 occurs when resetting due to the drive level being the maximum [5]. A drive pulse corresponding to image data [3] is applied at the next frame 3F from these post-drive statuss B and now surplus response B4 is unfortunately invited.

In this way the CR drive method provides a drive voltage application period for the targeted transmittance and a discharge period within one frame period and an insufficient response and surplus response occurs with liquid crystal layer having a medium response characteristics.

Therefore, as shown in (c) of FIG. 12, in the present embodiment post drive data that is the drive level and the post reset state of the liquid crystal at the current frame is created from the post reset state of the liquid crystal (post drive data) of the previous frame and the image data of the current frame. In the example in the diagram, the input image data is about [3] at frame 1F and the display drive level is set to [4]. As the result of this the transmittance of the liquid crystal attains the targeted level until completion of the drive pulse (C1 in the diagram). However, a response remnant occurs (C2 in the diagram) when resetting is complete and a completely black state does not arise. Thus, due to the response remnant at the time of completion of the resetting of frame 3F (C4 in the diagram) the drive level at frame 3F is, without connection to the input image data being [3], set to be lower than the targeted value. As the result of this, at the time of completion of the drive panel a surplus response does not occur at the time of completion of the drive panel (C5 in the diagram).

The second embodiment has the display drive data generation unit 12 shown in FIG. 3 for the purpose of carrying out CR driving. In the case of CR driving, the correction value conversion table 42, a correction value interpolation calculation unit 44 and a drive level calculation unit 46 are the same as in the first embodiment. In the second embodiment response remnant data at the time of completion of resetting is stored in and output from the differential value conversion table 32. Thus, highly precise response remnant data is generated by means of the interpolation calculation unit 34. This response remnant data is one type of post-drive status data Fp.

Thus, in the second embodiment, the post drive level calculation unit 36 is unnecessary and the response remnant data (post-drive status data), generated by means of the interpolation calculation unit 34, is stored at either one of the frame memories 20A and 20B and is used in order to generate the display drive data of the next frame.

Figures 13, 14A, 14B:
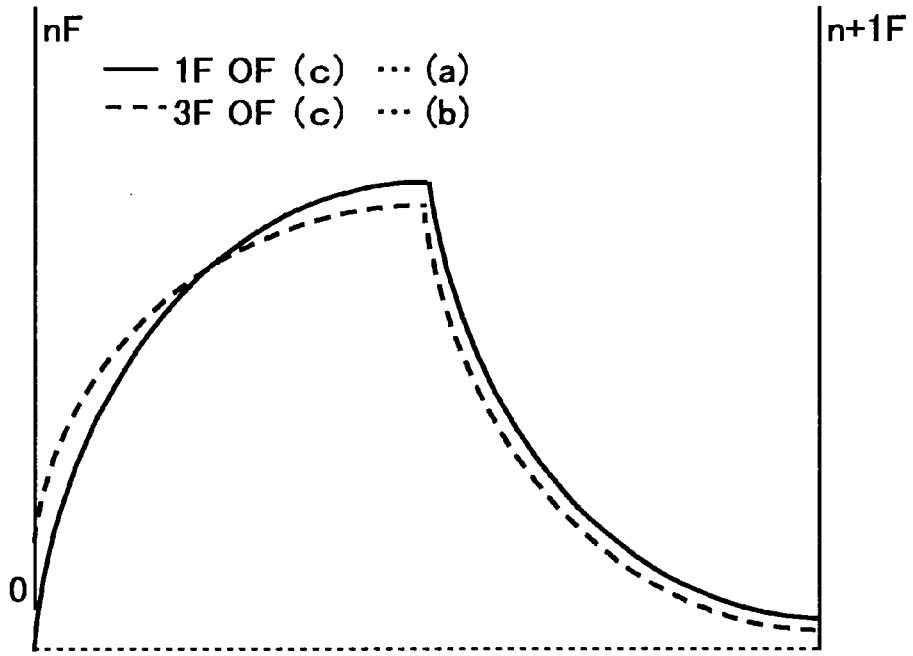
FIG. 13 is a waveform diagram showing in detail the optical response of a liquid crystal layer when the same display image data is driven.

As shown in FIG. 12, when the drive compensation method is used for the CR drive method the drive pulse at frame 1F and 3F becomes different even in the case of the same display image data [3] and the change in transmittance of the liquid crystal layer in response to that also becomes different. FIG. 13 is a waveform diagram showing in detail the optical response of the liquid crystal layer when the same display image data has been driven. In the FIG. the solid line is the optical response waveform of frame 1F of (c) of FIG. 12 and the broken line is the optical response waveform of frame 3F of (c) of FIG. 12.

In this way, even with the same display image data, the optical response waveform of the liquid crystal layer is different depending on the history of the pixels. In the case where image data of identical gradation values in contiguous pixels are supplied, the transmittance at each pixel is different and the phenomenon concerned becomes the cause of false outlines.

FIG. 14 is a drawing for the purpose of explaining the false outlines and the dispersion process. FIG. 14A shows the pixel region of 4 rows and 3 columns. Thus the upper 6 pixels are shown at optical response of the solid line (a) of FIG. 13 and the lower 6 pixels are shown at optical response of the broken line (b) of the same FIG. In this case, the false outlines occur at the border portion of 2 groups of pixel regions due to differences in optical response. The false outlines concerned invites a decrease in image quality.

Therefore, as shown in FIG. 14B, in the present embodiment a dispersion process is carried out to raise or lower the gradation level between the contiguous pixels by a preset minute level even with the same input image data. Especially, it is preferable if this dispersion process is carried out at border regions having different optical responses. For the purpose of carrying out this dispersion process, the input image levels of the contiguous pixels are compared, and if the same, the level of the display drive data is processed up or down by a minute value based on random or preset regulations. By this means the false outline scan be prevented from clearly appearing.

When this dispersion process is performed, it is anticipated that the outline of the image that should be displayed will be blurred. Accordingly, a preferred embodiment provides an edge filter corresponding to the performance of the dispersion process and a process that emphasizes the edge of the outline portion of the image is carried out.

Figure 15A:
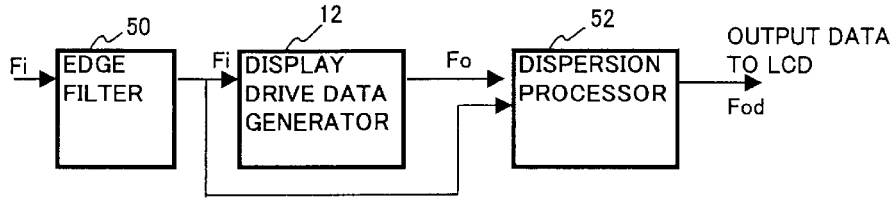
FIG. 15 shows a control circuit that provides an edge filter and a dispersion processing unit.
Figure 15B:
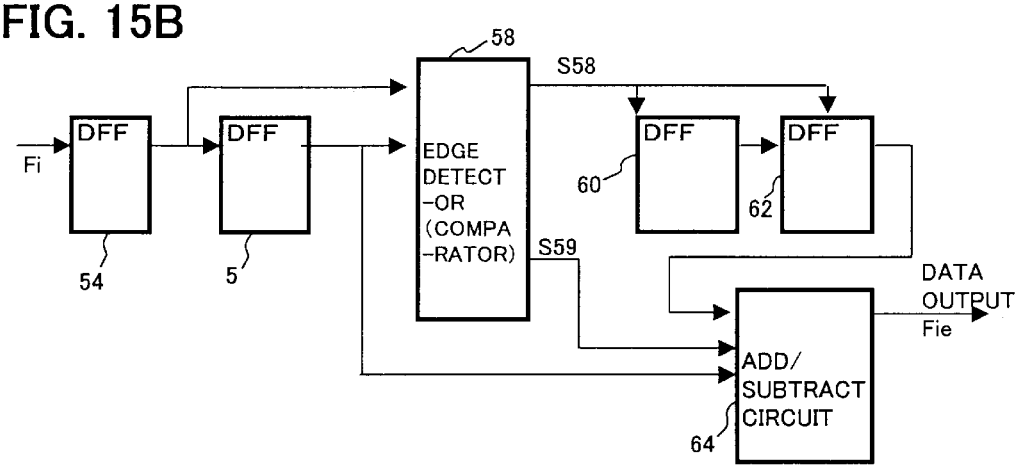
Figure 15C:
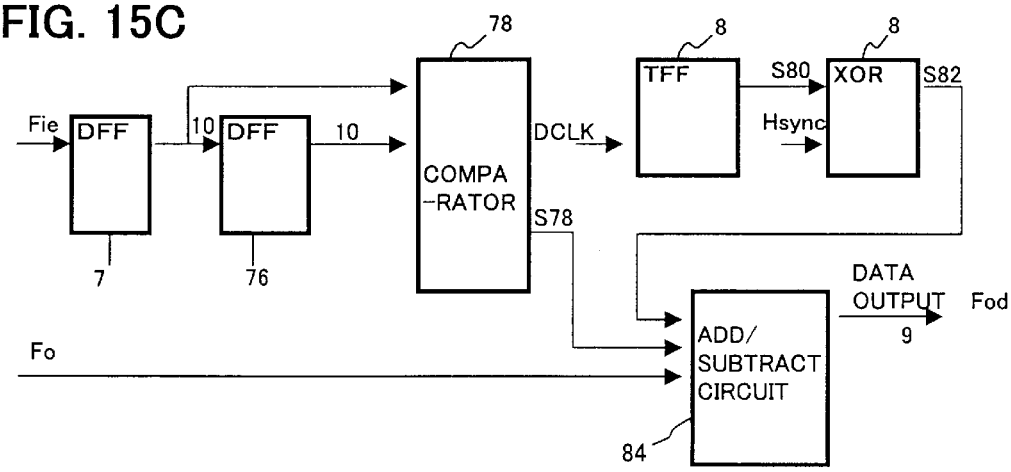

FIG. 15 shows a control circuit that provides an edge filter and dispersion processing unit. FIG. 15A shows the overall circuit of the control circuit, FIG. 15B shows an edge filter and FIG. 15C shows a dispersion processing unit respectively. Furthermore, FIG. 16 shows data processed by means of an edge filter and dispersion processing unit. Referring to both FIGS. an explanation will be made concerning the edge filter and dispersion processing unit.

Edge filter 50, provided at the front portion of display drive data generation unit 12, detects large changes in the gradation level of the input image data Fi and carries out a process to emphasize the level before and after the change. Furthermore, dispersion processing unit 52, provided at the rear portion of the display drive data generation unit 12, detects contiguous pixels having the same input image data Fi levels concerning the generated drive data Fo and the display drive level Fo of these pixels are raised or lowered by a minute value.

The edge filter circuit of FIG. 15B has delay flip flops 54 and 56 that shift the input image data Fi, an edge detection circuit 58 that compares the output of the flip flops, delay flip flops 62 and 60 that shift the add/subtract order bits S58 from the edge detection circuit, and an add/subtract circuit 64 that adds and subtracts the emphasized level to/from the input image data Fi by means of edge detection signal S59 and add/subtract order bits S58 from the edge detection circuit.

Figure 16A:
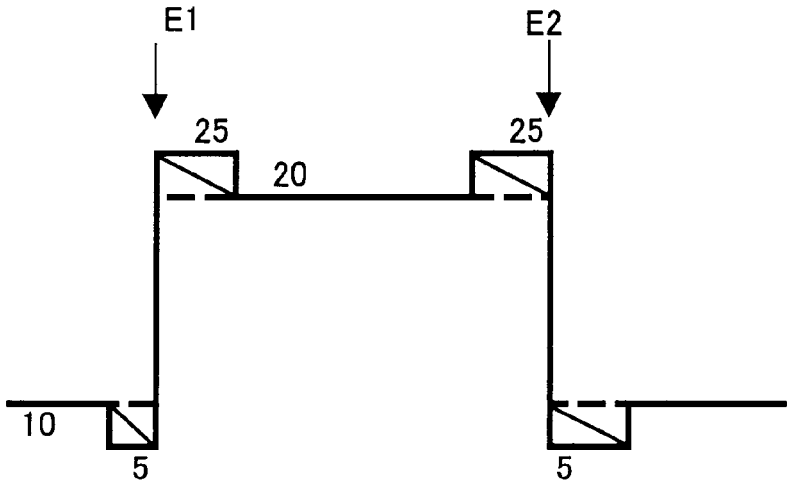
FIG. 16 shows data processed by means of the edge filter and dispersion processing unit.

As shown in FIG. 16A as an example, input image data is changed to gradation levels [10], [20], [10]. Since the gradations levels become greatly different at edges E1 and E2, that this timing is when the edge of the image is detected by the edge detection circuit 58. By the change of the level of the input image data from a low level to a high level, edge detection circuit 58 makes edge detection signal S59 into an activated level and together with this, at the same time, add/subtract order bits S58 are made negative (0), positive (1) in order. These add/subtract order bits S58 are shifted by the delay flip flops 62 and 60 and supplied to the add/subtract circuit 64.

At the add/subtract circuit 64 a predetermined value [5] is subtracted from the input image data [10] immediately before the edge and a predetermined value [5] is added to the input image data [10] immediately after the edge and the completed edge emphasis of the image data Fie is output.

In the same manner, since the gradation level changes from a high level to a low level at the timing of edge E2, add/subtract order bits S58 are made positive (1), negative (0) in order. As a result, at add/subtract circuit 64 a predetermined value [5] is added to the input image data [10] immediately before the edge and a predetermined value [5] is subtracted from the input image data [10] immediately after the edge and the completed edge emphasis of the image data Fie is output.

Next an explanation will be made concerning the dispersion processing circuit of FIG. 15C with reference to the waveform diagram of 16B. The dispersion processing circuit has delay flip flops 74 and 76 that shift the input image data, a comparison unit 78 that compares there outputs and detects whether the gradation levels are the same or not, a T type flip flop 80 that toggles the output between [0], [1] synchronized with the dot clock DCLK, exclusive OR gate 82 that reverses output S80 of the flip flop 80 in synchronization with horizontal synchronous signal Hsync and outputs add/subtract order bits S82 to an add/subtract unit, and an add/subtract unit 84 which adds and subtracts a minute value to or from drive data Fo in accordance with the add/subtract order bits S82 in synchronization with detection signal S78 from the comparison unit 78.

Figure 16B:
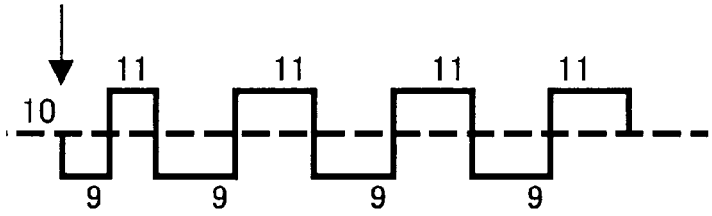

As shown in FIG. 16B, in the case where the gradation level of the input image data is set to [10], the comparison unit 78 detects this and the add/subtract unit 84 adds or subtracts a minute value [1] to or from the input image data at each pixel. At the next display line, add/subtract order bits S82 are reversed into the opposite pattern. Consequently, the add/subtract unit 84 subtracts or adds the minute portion [1] to or from the input image data at each pixel. As a result, display data Fod, to which dispersion processing has been performed has a gradation level which becomes a diffused gradation level as shown in FIG. 14B.

Returning to FIG. 1, the control circuit of the liquid crystal display device of the present embodiment has the temperature sensor 24. The temperature sensor 24 is used to detect the temperature when the device is in use and download the most suitable conversion table from the conversion table ROM. The display drive data generation unit 12 counts the vertical synchronous signal and, at each predetermined cycle, in accordance with the temperature information from the temperature sensor, downloads the most suitable conversion table from the ROM and presents it to the internal SRAM. By this means, the drive compensated drive data nFo is generated from the most suitable conversion table in consideration of the response characteristics of the liquid crystal material according to changes in the surrounding environment.

Concretely, since the response speed of the liquid crystal layer becomes faster to the degree that the detected temperature is high, the absolute value of the correction value in the correction value conversion table becomes a comparatively low value. Furthermore, since the response speed of the liquid crystal layer becomes slower to the degree that the detected temperature is low, the absolute value of the correction value in the correction value conversion table becomes a comparatively high value.

Furthermore, display drive data generation unit observes the frequency of the vertical synchronous signal Vsync. Then, the most suitable conversion table is downloaded from the ROM in response to the detected frequency and presented to the internal SRAM. For example, since the frame period is shorter when the frequency f is higher, the absolute value of the correction value in the conversion table becomes comparatively high. Furthermore, to the contrary, since the frame period is longer when the frequency f is lower, the absolute value of the correction value in the conversion table becomes a comparatively short.

According to the present invention, as set forth hereinabove, the response characteristics of the liquid crystal display device are improved and the image quality of the animated display can be improved.

What is claimed is:

1. A control circuit of a liquid crystal display device, comprising:

a display drive data generation unit that generates display drive data from a current frame image data and a previous frame image data, said display drive data generation unit including a conversion table that stores the display drive data or correction values therefor depending on combinations of said current frame image data and said previous frame image data, wherein said conversion table stores the display drive data or the correction values depending on combinations of upper bits of said current frame image data and upper bits of said previous frame image data, and an interpolation calculation unit that generates, from a plurality of contiguous the display drive data or correction values read out from said conversion table in accordance with lower bits of said current frame image data, the display drive data or the correction values, that is interpolated depending on said lower bits, by means of an interpolation calculation.

2. The control circuit of a liquid crystal display device according to claim 1, wherein said conversion table is grouped in accordance with and combinations of upper bits of said current frame image data and upper bits of said previous frame image data, and stores said display drive data or the correction values according to the grouped unit.

3. A control circuit of a liquid crystal display device, comprising:

a display drive data generation unit that generates a display drive data from a current frame image data and a post-drive status data of a previous frame, said display drive data generation unit including:

a first conversion table that stores the display drive data or correction values therefor depending on combinations of said current frame image data and said post-drive status data of the previous frame; and a post-drive status data generation unit that generates the post-drive status data of the current frame from said current frame image data and said post-drive status data of the previous frame, wherein said post-drive status data generation unit includes:

a second conversion table that stores the post-drive status data of the current frame or differential values therefor depending on combinations of upper bits of said current frame image data and upper bits of said post-drive status data of the previous frame; and a first interpolation calculation unit that generates, from a plurality of contiguous post-drive status data or the differential values read out from said second conversion table, in accordance with lower bits of said current frame image data, post-drive status data or the differential values that is interpolated, depending on said lower bits, by means of an interpolation calculation;

said post-drive status data, in order to find the display drive level at the next frame, being stored temporarily within a frame memory having a storage area corresponding to pixels.

4. The control circuit of a liquid crystal display device according to claim 3, wherein said first conversion table stores the display drive data or the correction values, depending on combinations of upper bits of said current frame image data and upper bits of said previous frame image data, and said display drive data generation unit includes a second interpolation calculation unit that generates, from a plurality of contiguous display drive data or the correction values read out from said first conversion table in accordance with lower bits of said current frame image data, the display drive data or the correction values, that is interpolated depending on said lower bits, by means of an interpolation calculation.

5. The control circuit of a liquid crystal display device according to claim 3, wherein said first conversion table is grouped in accordance with combinations of upper bits of said current frame image data and upper bits of said previous frame image data and stores said display drive data or the differential values according to the grouped units.

6. The control circuit of a liquid crystal display device according to claim 1 or 3, further comprising:

a conversion table memory that stores a plurality of sets of said first and/or second conversion tables; and temperature detection means;

said display drive data generation unit downloading the conversion table from said conversion table memory, according to a temperature detected by said temperature detection means at each predetermined cycles.

7. The control circuit of a liquid crystal display device according to claim 1 or 3, wherein said display drive data generation unit downloads the conversion table from said conversion table memory, at each predetermined cycles, according to the frequency of a horizontal synchronous signal or a vertical synchronous signal.

8. A control circuit of a liquid crystal display device with a charge reset drive type which applies a drive voltage to pixel electrodes in the first half of a frame period and applies a drive voltage corresponding to a gradation value of zero to said pixel electrodes in the second half of the frame period, said control circuit comprising:

a display drive data generation unit that generates a display drive data from a current frame image data and a previous frame image data, wherein said display drive data generation unit includes a first conversion table that stores said display drive data or correction values therefor depending on combinations of said current frame image data and said previous frame image data, and said drive voltage is generated in accordance with said display drive data or the correction values read out from said first conversion table.

9. A control circuit of a liquid crystal display device with a charge reset drive type which applies a drive voltage to pixel electrodes in the first half of a frame period and applies a drive voltage corresponding to a gradation value of zero to said pixel electrodes in the second half of the frame period, said control circuit comprising:

a display drive data generation unit that generates a display drive data, wherein said display drive data generation unit includes a first conversion table that stores said display drive data or correction values therefor corresponding to combinations of current frame image data and previous frame post-drive status data, and a second conversion table that stores post-drive status data of the current frame corresponding to combinations of said current frame image data and said previous frame post-drive status data, and said drive voltage is determined in accordance with the display drive data or the correction values read out from said first conversion table, and said post-drive status data, read out from said second conversion table, is stored temporarily in a frame memory.

10. The control circuit of a liquid crystal display device according to claim 8 or 9, further comprising:

a dispersion processing unit that, when the current frame image data having the same gradation are supplied to contiguous pixels, makes gradation values of said display drive data of the current frame generated for said contiguous pixels, different by a predetermined gradation value between said contiguous pixels.

11. The control circuit of a liquid crystal display device according to claim 8 or 9, wherein said display drive data generation unit includes, at a former stage thereof, an edge filter which, when the current frame image data having different gradation levels are supplied to contiguous pixels, increases/decreases or decreases/increases the gradation level of the current frame image data for said contiguous pixels.

12. The control circuit of a liquid crystal display device according to claim 8 or 9, wherein said first conversion table are grouped in accordance with combinations of upper bits of said current frame image data and upper bits of said previous frame image data and stores said display drive data or the differential values according to the grouped units.

13. The control circuit of a liquid crystal display device according to claim 8 or 9, further comprising:

a conversion table memory that stores a plurality of sets of said first and/or second conversion tables; and temperature detection means and, said display drive data generation unit downloading the conversion table from said conversion table memory, according to the temperature detected by said temperature detection means at each predetermined cycles.

14. The control circuit of a liquid crystal display device according to claim 8 or 9, wherein said display drive data generation unit downloads the conversion table from said conversion table memory, according to a frequency of a horizontal synchronous signal or a vertical synchronous signal at each predetermined cycles.

15. A liquid crystal display device comprising;

a control circuit according to any one of claims 1, 3, 8 and 9; and a liquid crystal display panel whose display is controlled by said control circuit.

* * * * *